US012752979B2

(12) United States Patent
Clerx et al.

(10) Patent No.: US 12,752,979 B2
(45) Date of Patent: Oct. 6, 2026

(54) TAMPER-EVIDENT CLOSURE WITH TAMPER-EVIDENT STRIP AND HOLDING CHAMBER FOR TAMPER-EVIDENT STRIP

(71) Applicant: Weener Plastics Group B.V., Ede (NL)

(72) Inventors: Ruben Clerx, Zutphen (NL); Sebastiaan Wilhelmus Josephus Den Boer, Twello (NL); Willem Ramon, Putten (NL); Marcel Pater, Maarssen (NL)

(73) Assignee: Silgan Dispensing Systems Group B.V., Ede (NL)

( * ) Notice: Subject to any disclaimer, the term of this patent is extended or adjusted under 35 U.S.C. 154(b) by 0 days.

(21) Appl. No.: 18/867,040

(22) PCT Filed: Jun. 15, 2023

(86) PCT No.: PCT/EP2023/066152
§ 371 (c)(1),
(2) Date: Nov. 19, 2024

(87) PCT Pub. No.: WO2023/242359
PCT Pub. Date: Dec. 21, 2023

(65) Prior Publication Data

US 2025/0256894 A1 Aug. 14, 2025

(30) Foreign Application Priority Data

Jun. 17, 2022 (NL) ..... 2032210

(51) Int. Cl.
*B65D 47/08* (2006.01)
*B65D 55/02* (2006.01)

(52) U.S. Cl.
CPC ..... *B65D 47/0828* (2013.01); *B65D 55/024* (2013.01); *B65D 2251/1058* (2013.01);
(Continued)

(58) Field of Classification Search
CPC ..... B65D 2401/15; B65D 47/0828; B65D 2251/1058; B65D 2251/1066
(Continued)

(56) References Cited

U.S. PATENT DOCUMENTS 8,292,103 B2 10/2012 Weist
8,490,804 B2 * 7/2013 Benoit-Gonin .... B65D 47/0838 215/322
(Continued)

FOREIGN PATENT DOCUMENTS

DE 295 12 523 U1 10/1995
EP 1 174 359 A2 1/2002
(Continued)

*Primary Examiner* — Orlando E Aviles
*Assistant Examiner* — Sanjidul Islam
(74) *Attorney, Agent, or Firm* — Hoffmann & Baron, LLP

(57) ABSTRACT

A closure for a container includes a closure body and a lid hingedly connected to the closure body. A tamper-evident strip is connected to the closure body by at least one frangible connection. The tamper-evident strip is coupled to the lid upon first-time closing of the lid, such that the lid is coupled to the closure body via the tamper-evident strip. The lid includes a holding chamber, which receives the tamper-evident strip upon first-time closing. The holding chamber has an engagement member adapted to move beyond and engage the tamper-evident strip upon first-time closing of the lid. The engagement member holds the tamper-evident strip in the holding chamber when it is separated from the closure body.

7 Claims, 6 Drawing Sheets

(52) U.S. Cl.
CPC .. *B65D 2251/1066* (2013.01); *B65D 2401/15* (2020.05); *B65D 2401/20* (2020.05)

(58) Field of Classification Search
USPC ..... 220/810, 266; 215/253
See application file for complete search history.

(56) References Cited

U.S. PATENT DOCUMENTS

| | | | |
|---|---|---|---|
| D713,724 | S | 9/2014 | Den Boer |
| 2008/0156858 | A1 | 7/2008 | Perry et al. |
| 2016/0244226 | A1 | 8/2016 | Dunn et al. |

FOREIGN PATENT DOCUMENTS

| | | | | |
|---|---|---|---|---|
| EP | 2 207 729 | B1 | 7/2011 | |
| EP | 2114788 | B1 * | 3/2014 | ..... B65D 55/024 |
| JP | 3628835 | B2 | 12/2004 | |
| JP | 2007-45421 | A | 2/2007 | |
| JP | 2007-45422 | A | 2/2007 | |
| WO | 2013/077732 | A1 | 5/2013 | |

* cited by examiner

TAMPER-EVIDENT CLOSURE WITH TAMPER-EVIDENT STRIP AND HOLDING CHAMBER FOR TAMPER-EVIDENT STRIP

CROSS-REFERENCE TO RELATED APPLICATIONS

This application is the National Stage of International Application No. PCT/EP2023/066152, filed Jun. 15, 2023, which claims the benefit of Netherlands Application No. 2032210, filed Jun. 17, 2022, the contents of which is incorporated by reference herein.

FIELD OF THE INVENTION

The present invention relates to tamper-evident closures for a container comprising a closure body and a lid hingedly connected to the closure body.

BACKGROUND OF THE INVENTION

Dispensing closures of this type comprise generally a closure body having a deck and a circumferential skirt, wherein a dispensing orifice is formed in the deck. A lid is hingedly connected to the closure body, the lid having a closed state in which it covers the dispensing orifice and at least a part of the deck, and having an open state in which it is swivelled away from the deck such that a product can be dispensed from the container through the dispensing orifice. Such dispensing closures are commonly made of a plastics material by injection moulding. The closures are adapted to be arranged on containers such as for example drinking bottles, squeeze bottles for edible substances, such as ketchup or honey, or for home and body care products.

In many applications a tamper-evident feature is required to evidence the first-time opening of the lid or tampering with the closure. Many solutions are known in which a tamper-evident strip (TE-strip) is formed which is connected to the closure body or the lid by frangible connections and which engages behind a locking edge or member on the lid or closure body to prevent opening of the lid without removing the tamper-evident strip. An example of such a closure is shown in DE 29512523 U1. A disadvantage of such a tamper-evident solution is that the TE-strip is removed from the closure at first-time opening of the closure and the user has to dispose of the loose plastic part. Such loose relatively small plastic parts pose an environmental problem, because they end up way too often in the environment instead of in a garbage bin and pollute nature.

Other tamper-evident closures known in the art have a tamper-evident push-button, which is held in or on the closure when the lid is opened for the first time. Examples of this type of closures are found in EP 1174359 A2, JP 3628835 and JP 2007045421, wherein a push-button button is formed in one piece with the closure body. JP 2007045422 shows a solution in which a separately formed button is locked in the closure body.

The invention has for an object to provide a tamper-evident closure, which does not produce a loose part.

This is object is achieved by a dispensing closure according to the invention.

SUMMARY OF THE INVENTION

A dispensing closure for a container, said dispensing closure comprising:

a closure body having a deck and a circumferential skirt, wherein a dispensing orifice is formed in the deck and a recess is formed in the circumferential skirt, which recess has a deck-sided end, a lid which is hingedly connected to the closure body, the lid having a closed state in which it covers the dispensing orifice and at least a part of the deck, and having an open state in which it is swivelled away from the deck about a hinging axis, such that a product can be dispensed from the container through the dispensing orifice, wherein a tamper-evident strip extends over the deck-sided end of the recess and is connected to the closure body by at least one frangible connection, said tamper-evident strip being coupled to the lid upon first-time closing of the lid, such that the lid is coupled to the closure body via the tamper-evident strip, wherein the lid includes a holding chamber for the tamper-evident strip, which holding chamber receives the tamper-evident strip upon first-time closing and has an engagement member adapted to move beyond and engage the tamper-evident strip upon first-time closing, and which engagement member is adapted to hold the tamper-evident strip in the holding chamber when it is separated from the closure body.

The tamper-evident closure is manufactured in one piece by an injection moulding process. The closure is injection moulded with the lid in an open state. After the closure is ejected from the injection mould, the lid is closed for a first time after which the lid can only be opened by breaking the tamper-evident strip loose from the closure. According to the invention the lid includes a holding chamber for the tamper-evident strip. The holding chamber receives the tamper-evident strip upon first-time closing and has an engagement member adapted to move beyond and engage the tamper-evident strip upon first-time closing. The engagement member is adapted to hold the tamper-evident strip in the holding chamber when it is separated from the closure body by rupturing the at least one frangible connection, whereby the tamper-evident strip remains captured in the holding chamber and does not become a loose part which can be lost.

The engagement member may be a locking member, e.g. a hooking member that hooks behind the tamper-evident strip. However, also another engagement member, such as a clamping member can be applied.

In an embodiment the lid has a peripheral skirt, and the holding chamber is formed on an inner side of said peripheral skirt. In this embodiment the tamper-evident strip is hidden inside the peripheral skirt of the lid, which gives the closure a smooth appearance.

In an embodiment:

a push-button is formed in one piece with the closure body, wherein the closure body and the push-button are permanently connected by a hinge, the tamper-evident strip is connected to the push-button by at least one frangible connection, such that the lid is coupled to the closure body via the push-button upon first-time closing of the lid, and the recess is adapted to allow the push-button to be pushed so as to break the at least one frangible connection to decouple the lid from the push-button and allow opening of the lid.

In this embodiment a tamper-evident strip is combined with a push-button. When the push-button is pushed in the first time, the at least one frangible connection is broken, whereby the tamper-evident strip is separated from the push-button. Moreover, the push-button is pushed in the recess and therefore a space is created underneath the edge of the lid, where the user can insert a fingertip to lift the lid upwardly.

In a further embodiment the tamper-evident strip is connected directly to the closure body next to the recess by additional frangible connections. There is thus a frangible connection between the push-button and the tamper-evident strip which is broken when the push-button is pushed in, and the additional frangible connections are broken by lifting the lid upwardly. Breaking all the frangible connections is thus a two-stage process.

In a further embodiment, on either side of the recess, there is located at least one of said additional frangible connections.

In a further embodiment retaining means are provided adapted to retain the push-button in a pushed-in state in the recess after first-time opening. This feature provides that the push-button indicates clearly that the closure has been opened for the first time.

In a further embodiment the lid has a pull ridge adapted to pull the lid to an open state, wherein the push-button in the non-pushed-in state is flush with said ridge such that a user cannot pull the ridge, and wherein in the pushed-in state of the push-button the pull ridge is released allowing a user to pull the lid to an open state. If the push-button is not pushed in for the first time, this embodiment prevents that a user can grip under the pull ridge with a finger. The lid can thus not be pulled up to an open state without pushing in the push-button first. This warrants that the first-time opening always triggers the pushed in state of the push-button and that first-time opening is thus always clearly visible, in particular if retaining means are present that retain the push-button in a pushed-in state in the recess after first-time opening.

It is envisaged that the idea according to the invention wherein a tamper evident strip is received in a holding chamber as is described in the above for a dispensing closure can also be used in closures having basically the same structure as the dispensing closure, i.e. a structure having a closure body that is adapted to be arranged on and connected to a container, and having a lid which is hingedly connected to the closure body. For example one can think of closures to be arranged on containers containing powdered or granular products, such as for example infant formula, powdered milk etc., which closures basically have an annular base, i.e. the closure body, which is attached to an upper side of the container, which may for example be an open top can. The annular base that is attached or to be attached to the container defines an access opening through which content of the container, e.g. infant formula, can be taken from the container. The lid is hingedly connected to the annular base and covers the opening in a closed state. In an open state the opening is free and product can be taken from the container via the opening. Such closures are commonly made of a plastics material by injection moulding.

Consequently the invention also relates to a closure for a container, said closure comprising:

a closure body having a top side and a circumferential skirt, wherein an opening is formed in the top side, and wherein a recess is formed in the circumferential skirt, which recess has a top-sided end, a lid which is hingedly connected to the closure body, the lid having a closed state in which it covers the opening, and having an open state in which it is swivelled away from the top side about a hinging axis, such that a product can be dispensed or taken from the container through the opening, wherein a tamper-evident strip extends over the top-sided end of the recess and is connected to the closure body by at least one frangible connection, said tamper-evident strip being coupled to the lid upon first-time closing of the lid, such that the lid is coupled to the closure body via the tamper-evident strip, wherein the lid includes a holding chamber for the tamper-evident strip, which holding chamber receives the tamper-evident strip upon first-time closing and has an engagement member adapted to move beyond and engage the tamper-evident strip upon first-time closing, and which engagement member is adapted to hold the tamper-evident strip in the holding chamber when it is separated from the closure body.

The tamper-evident closure is manufactured in one piece by an injection moulding process. The closure is injection moulded with the lid in an open state. After the closure is ejected from the injection mould, the lid is closed for a first time after which the lid can only be opened by breaking the tamper-evident strip loose from the closure. According to the invention the lid includes a holding chamber for the tamper-evident strip. The holding chamber receives the tamper-evident strip upon first-time closing and has an engagement member adapted to move beyond and engage the tamper-evident strip upon first-time closing. The engagement member is adapted to hold the tamper-evident strip in the holding chamber when it is separated from the closure body by rupturing the at least one frangible connection, whereby the tamper-evident strip remains captured in the holding chamber and does not become a loose part which can be lost.

Further embodiments of the closure may comprise the features, which are also described herein and explained in the above.

The invention will be further elucidated with reference to the drawings.

DETAILED DESCRIPTION OF THE INVENTION

Figure 1:
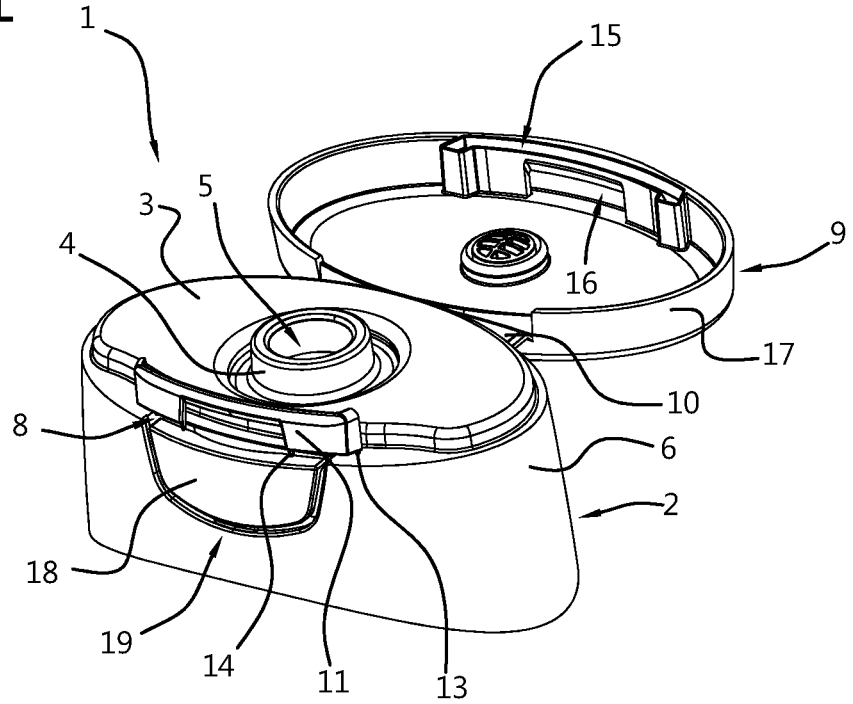
FIG. 1 shows an isometric view of an embodiment of a closure according to the invention in an initial open state before first-time closing.

In the FIGS. 1-9 a dispensing closure 1 for a container is shown. The dispensing closure 1 comprises a closure body 2 having a deck 3 and a circumferential skirt 6. In the deck 3 a spout 4 is formed which defines a dispensing orifice 5.

Figure 5:
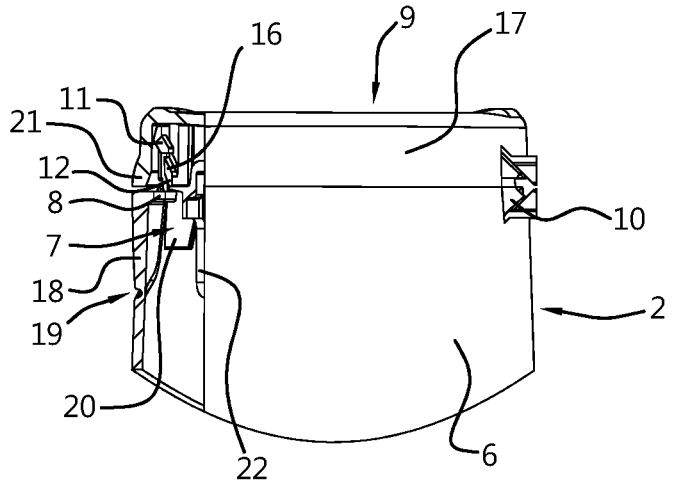
FIG. 5 shows a partially sectioned side view of the closure of FIG. 1 in the closed state of FIG. 4.
Figure 6:
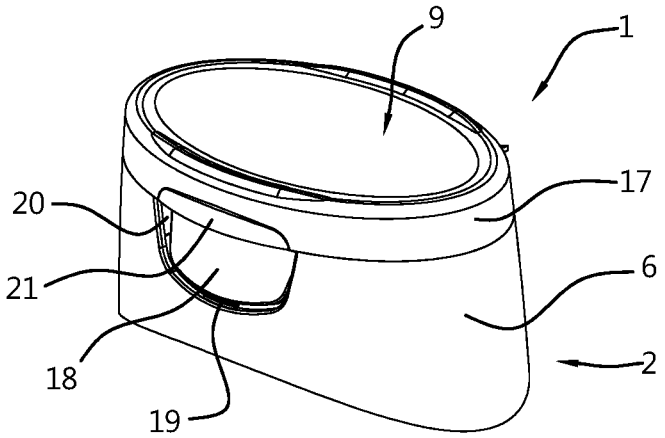
FIG. 6 shows an isometric view of the closure of FIG. 4 with a push-button in a pushed in state.

In the circumferential skirt 6 a recess 7 is formed (cf. FIG. 5). The recess 7 has a deck-sided end 8.

Figure 7:
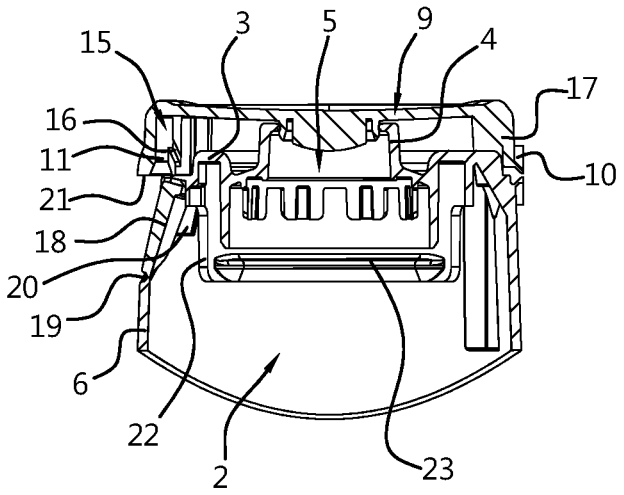
FIG. 7 shows the closure of FIG. 6 in cross section.
Figure 9:
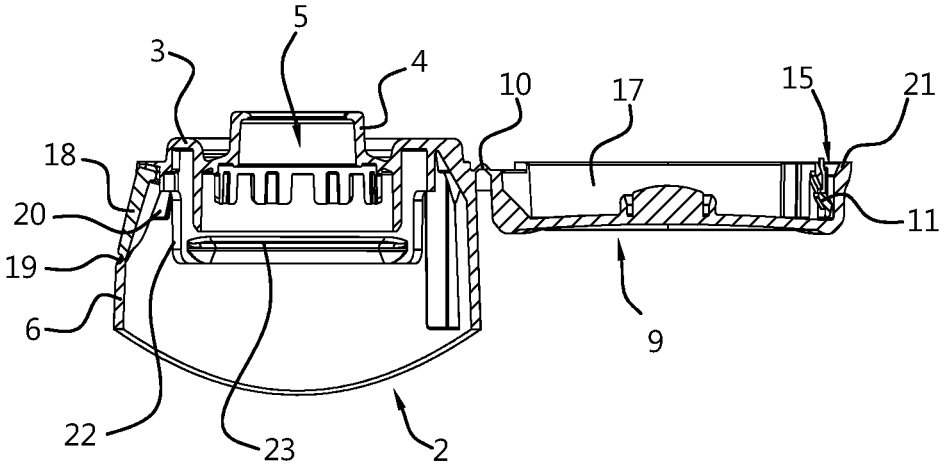
FIG. 9 shows the lid of FIG. 8 in a cross-section.

As is best visible in the cross sections of FIGS. 7 and 9 the closure body 2 has an inner skirt 22. The inner skirt 22 is adapted to position and attach the closure body 2 to a container neck. To this end the inner skirt 22 in this specific embodiment has an inwardly facing snap bead 23. It is also possible to attach the inner skirt with other means, e.g. by a screw thread formed on the inner side of it (not shown).

The dispensing closure 1 furthermore comprises a lid 9 which is hingedly connected to the closure body 2 by a hinge 10. The lid 9 has a closed state, illustrated in FIG. 4-7, in which it covers the dispensing orifice 5 and the deck 3. The lid 9 also has an open state, illustrated in FIGS. 1-3, 8-9 in which it is swivelled away from the deck 3 about a hinging axis defined by the hinge 10. In the open state a product can be dispensed from the container through the dispensing orifice 5.

A tamper-evident strip 11 extends over the deck-sided end 8 of the recess 7 and is connected directly to the closure body 2 by frangible connections 12 and 13. The frangible connections 12 and 13 are located next to the recess 7 on either side of the recess 7 seen in a front view (cf. FIG. 2).

A push-button 18 is formed in one piece with the closure body 2 wherein the closure body 2 and the push-button 18 are permanently connected by a hinge 19. The tamper-evident strip 11 is connected to the push-button 18 by a frangible connection 14, such that the lid 9 is coupled to the closure body 2 via the push-button 18, the frangible connection 14 and the tamper-evident strip upon first-time closing of the lid 9. The recess 7 behind the push-button 18 (cf. FIG. 5) allows the push-button 18 to be pushed inwardly so as to break the frangible connection 14 to decouple the lid 9 from the push-button 18 and allow opening of the lid 9.

The tamper-evident strip 11 is coupled to the lid 9 upon first-time closing of the lid 9, such that the lid 9 is coupled to the closure body 2 via the tamper-evident strip 11.

The lid 9 includes a holding chamber 15 for the tamper-evident strip 11. The lid 9 has a peripheral skirt 17. The holding chamber 15 is formed on an inner side of said peripheral skirt 17. The holding chamber 15 is moved over the tamper-evident strip 11 upon first-time closing of the lid 9 and receives the tamper-evident strip 11. The holding chamber 15 has an engagement member 16 formed as hooking member adapted to move beyond and hook behind the tamper-evident strip 11 upon first-time closing of the lid. The engagement member 16 is adapted to hold the tamper-evident strip 11 in the holding chamber 15 when it is separated from the closure body 2.

Figure 8:
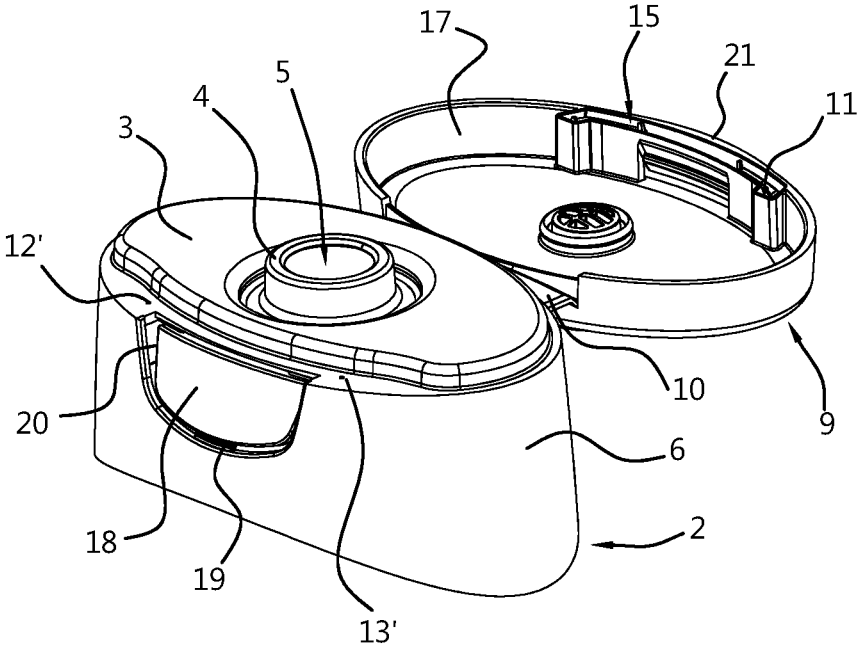
FIG. 8 shows an isometric view of the closure of FIG. 1 in an open state of the lid.

Retaining means 20 are provided adapted to retain the push-button 18 in a pushed-in state in the recess 7 shown in FIG. 7-9, after first-time pushing in the push-button 18, and possibly opening of the lid 9. The retaining means 20 in this embodiment hold the push-button by a clamping force, but also other type of retaining means may be applied, such as snap means or other locking means. The retainment of the push-button in the pushed in state provides the user with a clear indication that the closure may have been opened for the first time. At least it indicates that the button 18 has been pushed and at least one of the frangible connections of the tamper-evident structure has been broken.

Figure 4:
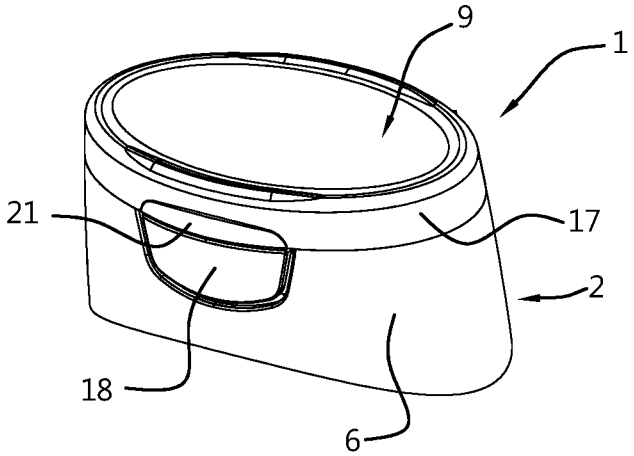
FIG. 4 shows an isometric view of the closure of FIG. 1, in a closed state before first-time opening.

The lid 9 has a pull ridge 21 adapted to pull the lid 9 to an open state. The push-button 18 in the non-pushed in state, shown in FIGS. 4 and 5 is flush with said ridge 21 which prevents that a user can grip under the pull ridge with a finger. The lid 9 can thus not be pulled up to an open state without pushing in the push-button 18 first. The push-button 18 is pushed with an upper portion in the recess 7 and therefore a space is created underneath the edge 21 of the lid 9, where the user can insert a fingertip to tilt the lid 9 upwardly. This guarantees that the first-time opening requires to push the push-button 18 in (cf. FIG. 6-9) and that first-time opening is thus always clearly visible. This is in particular the case if the mentioned retaining means 20 are present that retain the push-button 18 in a pushed-in state in the recess 7 after first-time pushing in and possibly opening the lid 9. In the pushed-in state of the push-button 18, shown in FIGS. 6 and 7, the pull ridge 21 is accessible, allowing a user to pull the lid 9 to an open state for the first time or a subsequent time. The breaking of the frangible connections 12-14 thus takes place in two stages: The first set of frangible connections-comprising the frangible connection 14—is broken by pushing the push-button 18. The second set of frangible connections—comprising the frangible connections 12 and 13—is broken by actually opening the lid 9. The locations of the frangible connections 12 and 13 remain visible on the deck after the separation of the tamper-evident strip 11 from the closure body 2 and are indicated in FIG. 8 by reference numerals 12' and 13'.

Figure 2:
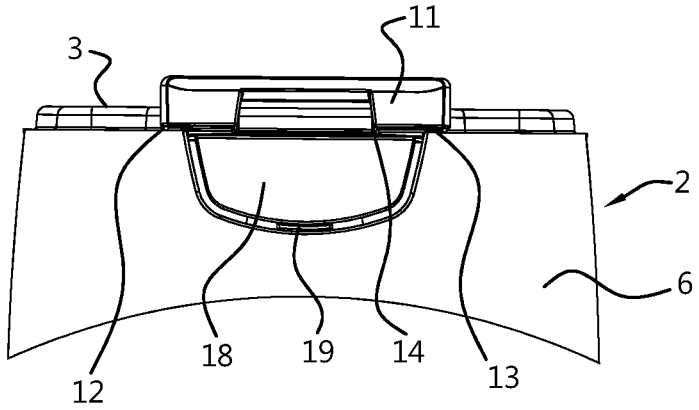
FIG. 2 shows a front elevational view of the closure of FIG. 1 in the initial open state.
Figure 3:
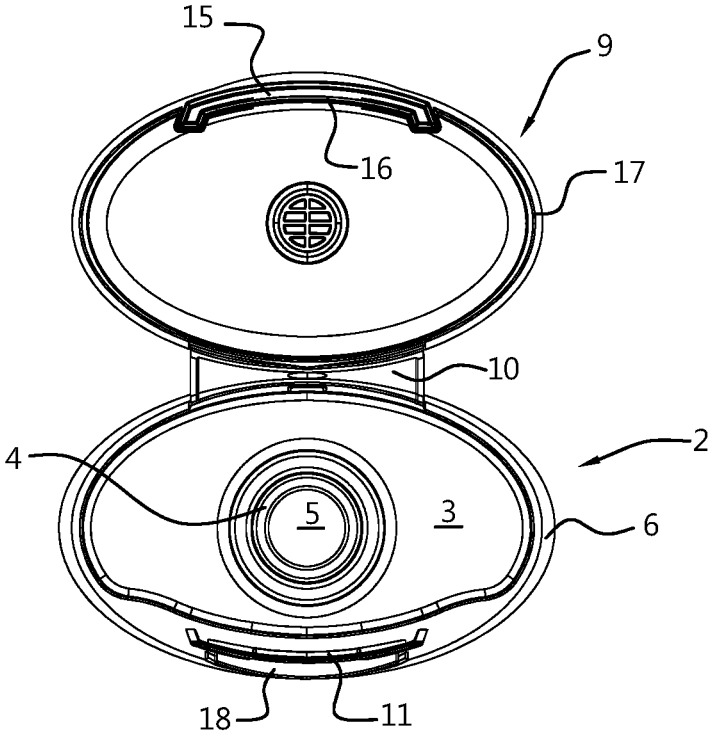
FIG. 3 shows a top elevational view of the closure of FIG. 1 in the initial open state.

The dispensing closure 1 is made in one piece by injection moulding a suitable thermoplastic material, e.g. PE or PP. The dispensing closure 1 is injection moulded in an open state, which is shown in FIGS. 1-3. After the product is ejected from the mould and is sufficiently cured, the lid 9 can be closed and brough to the state shown in FIGS. 4 and 5 in an automated process. When the lid 9 is closed for the first time, the engagement member 16 passes the tamper-evident strip 11 and locks itself with respect to the tamper-evident strip 11, e.g. by snapping in a recess under the tamper-evident strip when it has moved beyond the strip. The lid 9 is now locked with regard to the closure body 2 and the closure 1 can be transported and placed on a container filled with substance to be dispensed, such as edible substance, e.g. sauce or ketchup, or a body care substance. Before the substance can be dispensed via the dispensing closure, the push-button 18 has to be pushed in and the lid 9 has to be lifted for the first time to separate the tamper-evident strip 11 from the closure body 2, as was already described in the above.

The idea according to the invention wherein a tamper evident strip is received in a holding chamber as is described in the above for a dispensing closure as shown in the FIGS. 1-9 can also be used in closures having basically the same structure as the dispensing closure, i.e. a structure having a closure body that is adapted to be arranged on and connected to a container, and having a lid which is hingedly connected to the closure body. For example one can think of closures to be arranged on containers containing powdered or granular products, such as for example infant formula, powdered milk etc., which closures basically have an annular base, i.e. the closure body, which is attached to an upper side of the container, which may for example be an open top can. The lid is hingedly connected to the annular base. An example of such a closure is shown in FIG. 10, wherein like parts are designated with the same reference numerals as in the above description with reference to FIGS. 1-9, and provided with an accent (').

Figure 10:
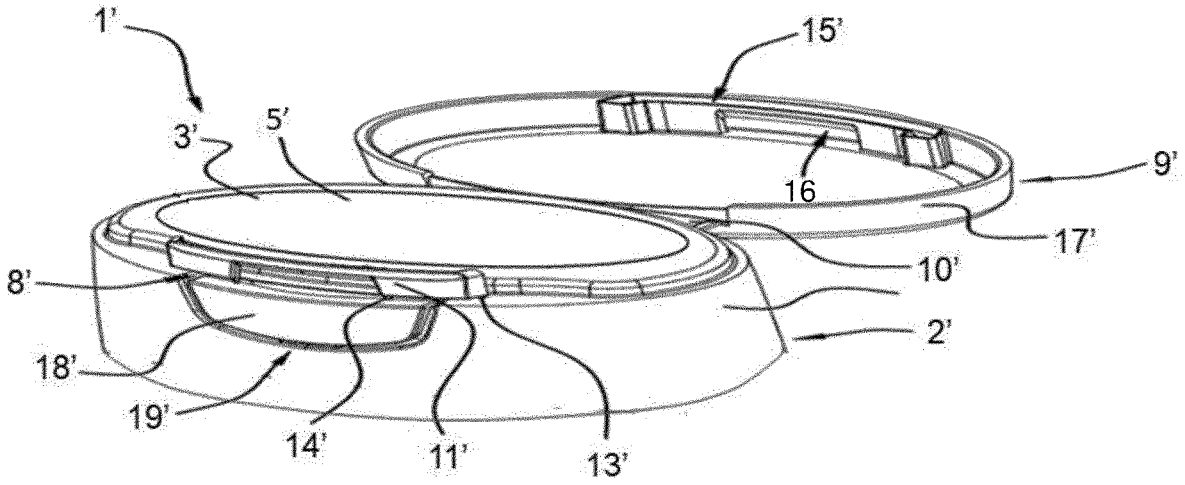
FIG. 10 shows an isometric view of another embodiment of a closure according to the invention in an initial open state before first-time closing.

In FIG. 10 a closure 1 for a container is shown. The container, which is not shown, may be a container having an open top which may for example contain a granular or powdered product, such as infant formula, powder milk or nutritional supplements. The closure 1 comprises a closure body 2' having a top side 3' and a circumferential skirt 6'. In the top side 3' an opening 5' is formed, which allows access to the container on which the closure is placed. The closure body 2' thus forms annular base. In the circumferential skirt 6' a recess 7' is formed. The recess 7' has a top-sided end 8'.

The closure 1' furthermore comprises a lid 9' which is hingedly connected to the closure body 2' by a hinge 10'. The lid 9' has a closed state, in which it covers the opening 5' the upper side 3'. The lid 9' also has an open state, illustrated in FIG. 10 in which it is swivelled away from the upper side 3' about a hinging axis defined by the hinge 10'. In the open state a product can be taken from the container through the opening 5'. For example powdered product can be taken from the container using a scoop or spoon.

Further features of the closure of FIG. 10 correspond to the same features in the closure of FIGS. 1-9. Therefore one is referred to the foregoing description with reference to the FIGS. 1-9 in which the same parts are described and indicated with the same reference numerals, but without an accent

The invention claimed is:

1. A dispensing closure for a container, said dispensing closure comprising:

a closure body having a deck and a circumferential skirt, wherein a dispensing orifice is formed in the deck and a recess is formed in the circumferential skirt, which recess has a deck-sided end, a lid which is hingedly connected to the closure body, the lid having a closed state in which it covers the dispensing orifice and at least a part of the deck, and having an open state in which it is swivelled away from the deck about a hinging axis, such that a product can be dispensed from the container through the dispensing orifice, wherein a tamper-evident strip extends over the deck-sided end of the recess and is connected to the closure body by at least one frangible connection, said tamper-evident strip being coupled to the lid upon first-time closing of the lid, such that the lid is coupled to the closure body via the tamper-evident strip, wherein the lid includes a holding chamber for the tamper-evident strip, which holding chamber receives the tamper-evident strip upon first-time closing and has an engagement member adapted to move beyond and engage the tamper-evident strip upon first-time closing, and which engagement member is adapted to hold the tamper-evident strip in the holding chamber when it is separated from the closure body, and wherein:

a push-button is formed in one piece with the closure body, wherein the closure body and the push-button are permanently connected by a hinge, the tamper-evident strip is connected to the push-button by at least one frangible connection, such that the lid is coupled to the closure body via the push-button upon first-time closing of the lid, and the recess is adapted to allow the push-button to be pushed so as to break the at least one frangible connection to decouple the lid from the push-button and allow opening of the lid.

2. The dispensing closure according to claim 1, wherein the lid has a peripheral skirt, and wherein the holding chamber is formed on an inner side of said peripheral skirt.

3. The dispensing closure according to claim 1, wherein the tamper-evident strip is connected directly to the closure body next to the recess by additional frangible connections.

4. The dispensing closure according to claim 1, wherein on either side of the recess there is located at least one of said additional frangible connections.

5. The dispensing closure according to claim 1, wherein retaining means are provided adapted to retain the push-button in a pushed-in state in the recess after first-time opening.

6. The dispensing closure according to claim 1, wherein the lid has a pull ridge adapted to pull the lid to an open state, wherein the push-button in the non-pushed in state is flush with said pull ridge such that a user cannot pull the ridge, and wherein in the pushed in state of the push-button the pull ridge is accessible allowing a user to pull the lid to an open state.

7. A closure for a container, said closure comprising:

a closure body having a top side and a circumferential skirt, wherein an opening is formed in the top side, and wherein a recess is formed in the circumferential skirt, which recess has a top-sided end, a lid which is hingedly connected to the closure body, the lid having a closed state in which it covers the opening, and having an open state in which it is swivelled away from the top side about a hinging axis, such that a product can be dispensed or taken from the container through the opening, wherein a tamper-evident strip extends over the top-sided end of the recess and is connected to the closure body by at least one frangible connection, said tamper-evident strip being coupled to the lid upon first-time closing of the lid, such that the lid is coupled to the closure body via the tamper-evident strip, wherein the lid includes a holding chamber for the tamper-evident strip, which holding chamber receives the tamper-evident strip upon first-time closing and has an engagement member adapted to move beyond and engage the tamper-evident strip upon first-time closing, and which engagement member is adapted to hold the tamper-evident strip in the holding chamber when it is separated from the closure body, and wherein:

a push-button is formed in one piece with the closure body, wherein the closure body and the push-button are permanently connected by a hinge, the tamper-evident strip is connected to the push-button by at least one frangible connection, such that the lid is coupled to the closure body via the push-button upon first-time closing of the lid, and the recess is adapted to allow the push-button to be pushed so as to break the at least one frangible connection to decouple the lid from the push-button and allow opening of the lid.

* * * * *